US007118022B2

(12) United States Patent
Drees

(10) Patent No.: US 7,118,022 B2
(45) Date of Patent: Oct. 10, 2006

(54) ENHANCED DEVICE FOR ASSISTING IN THE REMOVAL OF CONTENTS FROM ITS PACKAGING

(75) Inventor: David Drees, Sioux City, IA (US)

(73) Assignee: Gateway Inc., Irvine, CA (US)

( * ) Notice: Subject to any disclaimer, the term of this patent is extended or adjusted under 35 U.S.C. 154(b) by 222 days.

(21) Appl. No.: 10/434,924

(22) Filed: May 9, 2003

(65) Prior Publication Data

US 2004/0222282 A1 Nov. 11, 2004

(51) Int. Cl.
*B65D 5/00* (2006.01)

(52) U.S. Cl. ..... 229/163; 229/126; 229/800

(58) Field of Classification Search ..... 229/243, 229/244, 163, 156, 149, 150, 122.29, 126, 229/800; 206/292, 298
See application file for complete search history.

(56) References Cited

U.S. PATENT DOCUMENTS 634,646 A * 10/1899 Knobeloch ..... 206/418
675,733 A * 6/1901 Hildebrand ..... 206/762
2,306,343 A * 12/1942 Neubecker et al. .... 229/117.15
3,157,344 A * 11/1964 Hennessey ..... 229/244
3,262,631 A * 7/1966 Belsinger ..... 229/122
3,357,542 A * 12/1967 Aquino et al. ..... 206/279
3,869,077 A * 3/1975 Tuura ..... 229/117.16
3,891,137 A 6/1975 Ellison et al.
3,989,181 A * 11/1976 Wilcox et al. ..... 229/117.17
5,011,021 A 4/1991 Coltrane et al.
5,083,667 A * 1/1992 Holder ..... 229/229
5,622,309 A * 4/1997 Matsuda et al. ..... 229/243

* cited by examiner

*Primary Examiner*—Tri M. Mai
(74) *Attorney, Agent, or Firm*—Jeffrey A. Proehl; Woods Fuller Shultz & Smith

(57) ABSTRACT

Foldout tabs for assisting with the removal of contents from a carton. When extended, the foldout tabs provide a leverage point on which a user may place one or both feet so that while pulling the contents from within the carton, the carton does not exhibit its normal tendency to follow the contents.

15 Claims, 5 Drawing Sheets

ENHANCED DEVICE FOR ASSISTING IN THE REMOVAL OF CONTENTS FROM ITS PACKAGING

CROSS REFERENCE TO RELATED APPLICATIONS

The present application is related to U.S. Patent Aapplication, Gateway Designation P1911US00, filed on Nov. 21, 2002, Patent Application in U.S. Ser.No. 10/301003, entitled, "Device for Assisting in the Removal of Contents from its Packaging," and is hereby incorporated by reference in its entirety.

FIELD OF THE INVENTION

The present invention generally relates to the field of packaging. More particularly, the present invention relates to an apparatus to assist in removing contents from packaging or shipping carton and a method for removing such contents.

BACKGROUND OF THE INVENTION

As evident from the huge expansion in mail order and Internet shopping, many more products are being purchased and delivered in packaging, boxes or shipping cartons. Furthermore, many consumer and business products that are purchased in retail outlets are provided in similar packaging, boxes or cartons. In many cases, the internal packing materials and the weight of the enclosed products tend to make it difficult to remove the purchased goods from the shipping carton, especially when the contents are bulky and/or heavy. This is due to at least three factors: the weight of the product, the friction of the packing material as it is pulled from the shipping carton and the air pressure or the vacuum created as the product is pulled out of the shipping carton. All these factors make it more difficult to remove the product from the shipping carton. As the user pulls on the product or packing material to remove it from the shipping carton, the shipping carton tends to move in the same direction.

Furthermore, the actions of the user sometimes make this situation worse. When the shipping carton moves with the product during removal, the industrious user will try to use his or her legs to hold the carton in place. This not only causes the user to exert pressure in a way that is not natural to them, but as they put pressure on the box, the box deforms, putting further pressure on the packing material or product, making the task even more difficult.

SUMMARY OF THE INVENTION

The present invention is directed to a device for assisting in the removal of a product from its carton. The product can be anything, but the intended advantages of this invention are best realized when the product is bulky or relatively heavy. Examples of such products are, but not limited to, computer systems, computer monitors, microwave ovens, television sets, water softeners, mattresses and even kitchen sinks.

This invention provides for one or more tabs that may form part of the shipping carton during shipping, but fold out so that the user can use the tab to provide leverage while pulling out the contents of the shipping carton. For example, a computer shipping carton may have tabs disposed on inside flaps of the shipping carton. The user would fold out the tab or tabs by pushing along a perforation. The user can then place his or her feet on one or two tabs, hence holding the shipping carton substantially on the floor while lifting its contents, e.g., the computer. The pop-out tabs provide a means for keeping the shipping container in place while pulling on its contents. The tabs could be integrated into the box cover flaps or the inside flaps; the better choice might be the inside cover flaps so that the box cover flaps remain intact and the box can be reused for other shipping purposes.

In many cases, one or two foldout tabs are sufficient to provide leverage for a single user to remove the contents from a shipping carton, but in some cases, due to size or weight, some contents require more than one user to get the contents out of the shipping carton. In this case, any number of pop-out tabs can be employed.

Although this invention has been described, for the most part, in relation to packaging material or shipping cartons, the concept of a foldout tab can be applied to many objects and this invention is not limited to packaging material of shipping cartons. For example, the disclosed invention can be used in storage cartons or boxes.

It is to be understood that both the forgoing general description and the following detailed description are exemplary only and are not restrictive of the invention as claimed. The general functions of this invention may be combined in different ways to provide the same functionality while still remaining within the scope of this invention. Although the descriptions generally use the terms, "shipping carton," "contents" and pop-out tab, this invention is not restricted to packaging used only for shipping, any particular contents including packing material and any specific method of providing a foldout tab.

DESCRIPTION OF THE DRAWING FIGURES

The numerous advantages of the present invention may be better understood by those skilled in the art by reference to the accompanying figures in which.

DETAILED DESCRIPTION

Reference will now be made in detail to the presently discussed embodiment of the current invention, examples of which are illustrated in the accompanying drawings.

Figure 1:
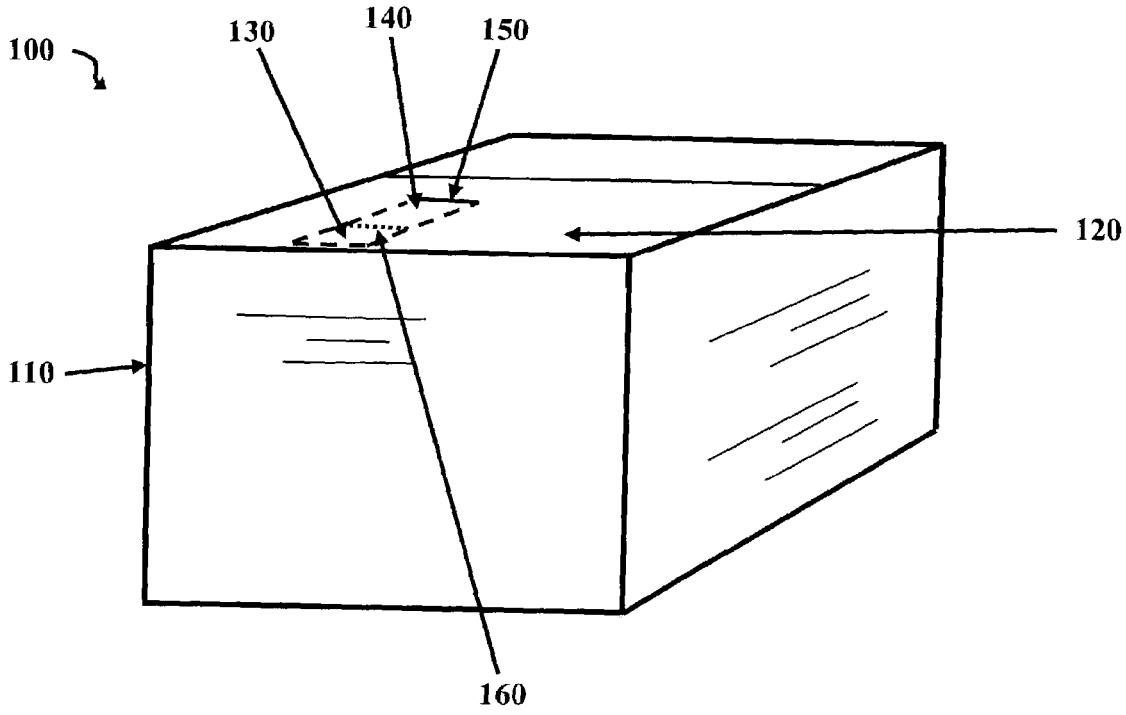
FIG. 1 shows a shipping carton with a single foldout tab positioned on an outside lid.

FIG. 1 shows a shipping carton comprising a foldout tab in accordance with the present invention. In this example, shipping carton 110 has one foldout tab 140 that is formed by perforating carton lid 120 in the desired shape of a foldout tab. In general, shipping cartons have two carton lids 120 and two inside flaps (not shown) that fold-over to seal the top of the carton, either of which might be referred to as cover flaps. Throughout this description, the examples show the foldout tab being disposed within the carton lids, but the foldout tab can be disposed in the carton lids, fold-over seal or both. Although, in this example, the foldout tab is shaped in the form of a rectangle, the actual shape is not important and can be formed from straight edges or curved. Additionally, the foot section 130 could be formed to resemble a human foot to aid in making the use of this device more obvious to the user. To use this device, the user opens lid 120 and then breaks the perforations around foldout tab 140, including foot 130 so that the foldout tab hinges away from lid 120 at hinge point 150. The user then bends foot 130 at hinge point 160 so that foot 130 lays substantially flat on the same surface that carton 110 rests upon. Then, the user can place their foot on foot 130 to hold carton 110 in place while removing its contents (not shown).

Figure 2:
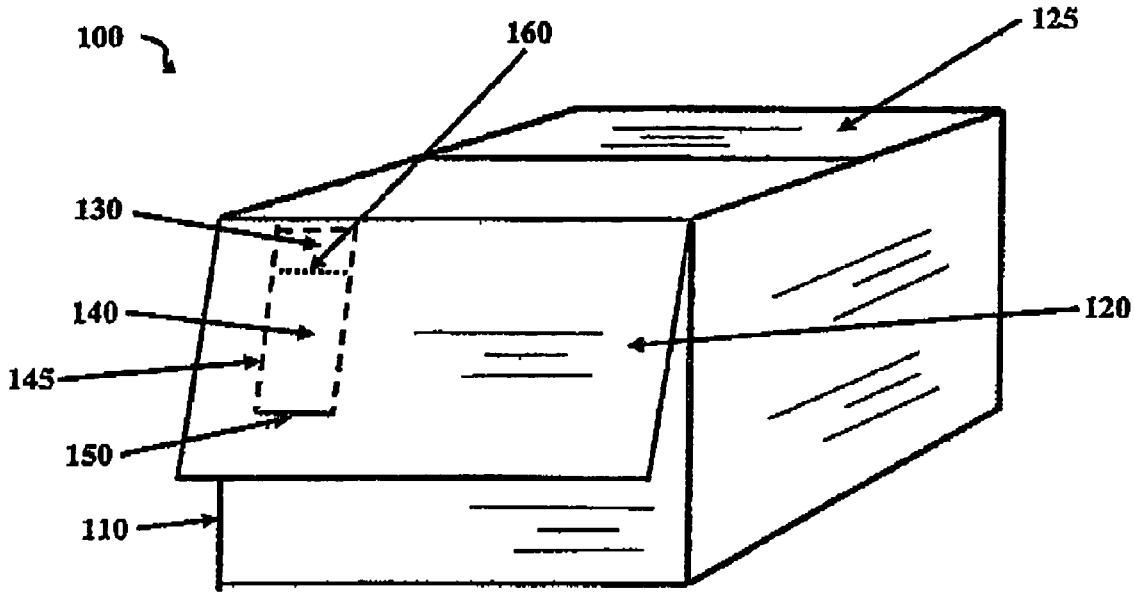
FIG. 2 shows the same shipping carton with the outside lid in the open position exposing the inside surface of the lid with the single foldout tab.

FIG. 2 shows a shipping carton comprising a foldout tab in accordance with the present invention. The shipping carton 110 has two carton lid sections, 120 and 125. Lid 12O is shown in a substantially open position, while lid 125 is shown in its closed position. Foldout tab 140 and foot 130 of this embodiment are shown intact within lid 120 and in position ready to be extended. Foot portion 130 is connected to the rest of foldout tab 140 at crease 160. Crease 160 may be a fold line, so that after foldout tab 140 and foot 130 are separated along perforation l45, foot 130 can be bent to lay flush on the same surface that holds shipping carton 110. Hinge line 150 can be a similar crease so that after foldout tab 140 and foot 130 are separated along perforation 145 they would hinge from lid 120 at hinge line 150.

Figure 3:
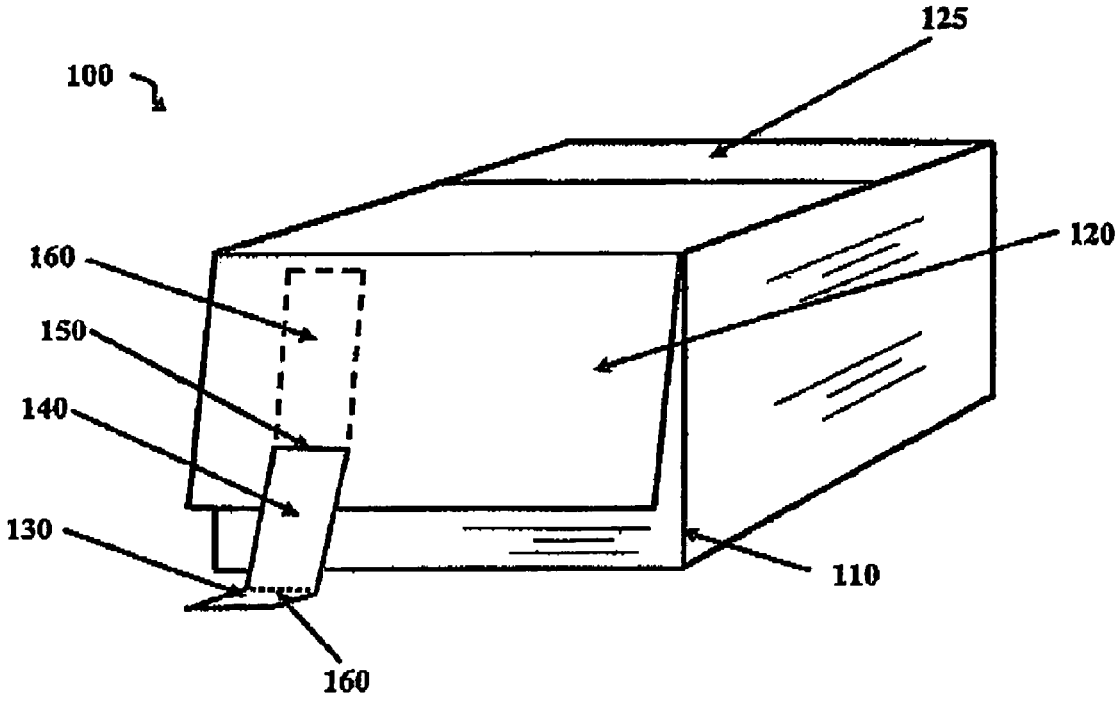
FIG. 3 shows the same shipping carton with the outside lid in the open position exposing the inside surface of the lid with the single foldout tab in the extended mode.
Figure 4:
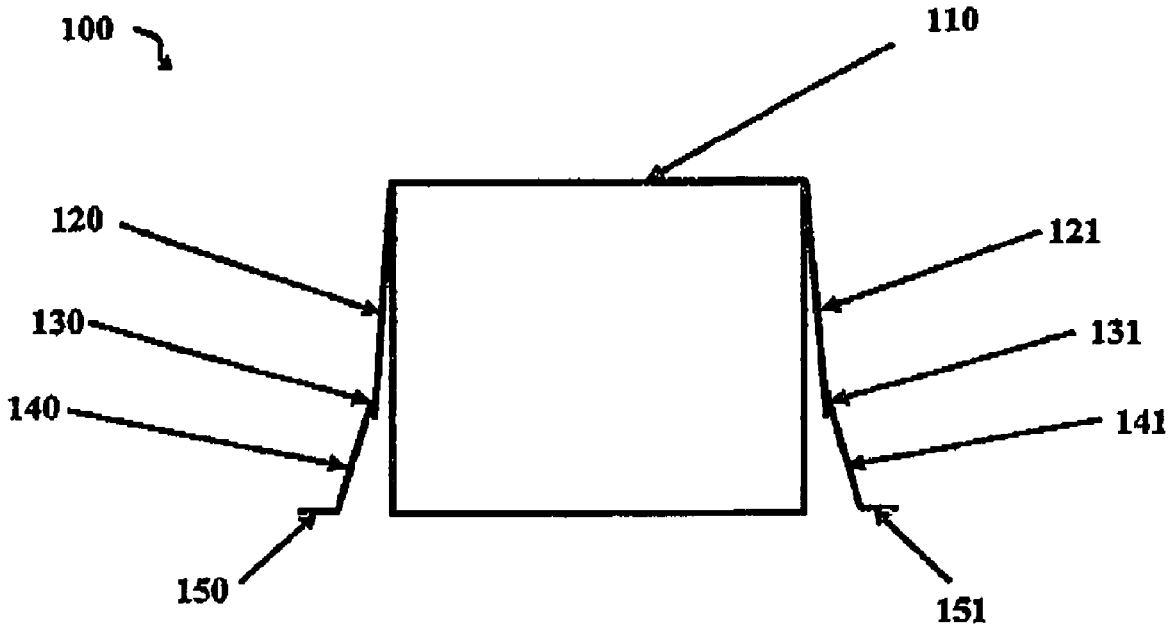
FIG. 4 shows a front view of the same shipping carton with two outside lids in the open position, with a foldout tab on each lid being in the extended condition.
Figure 5:
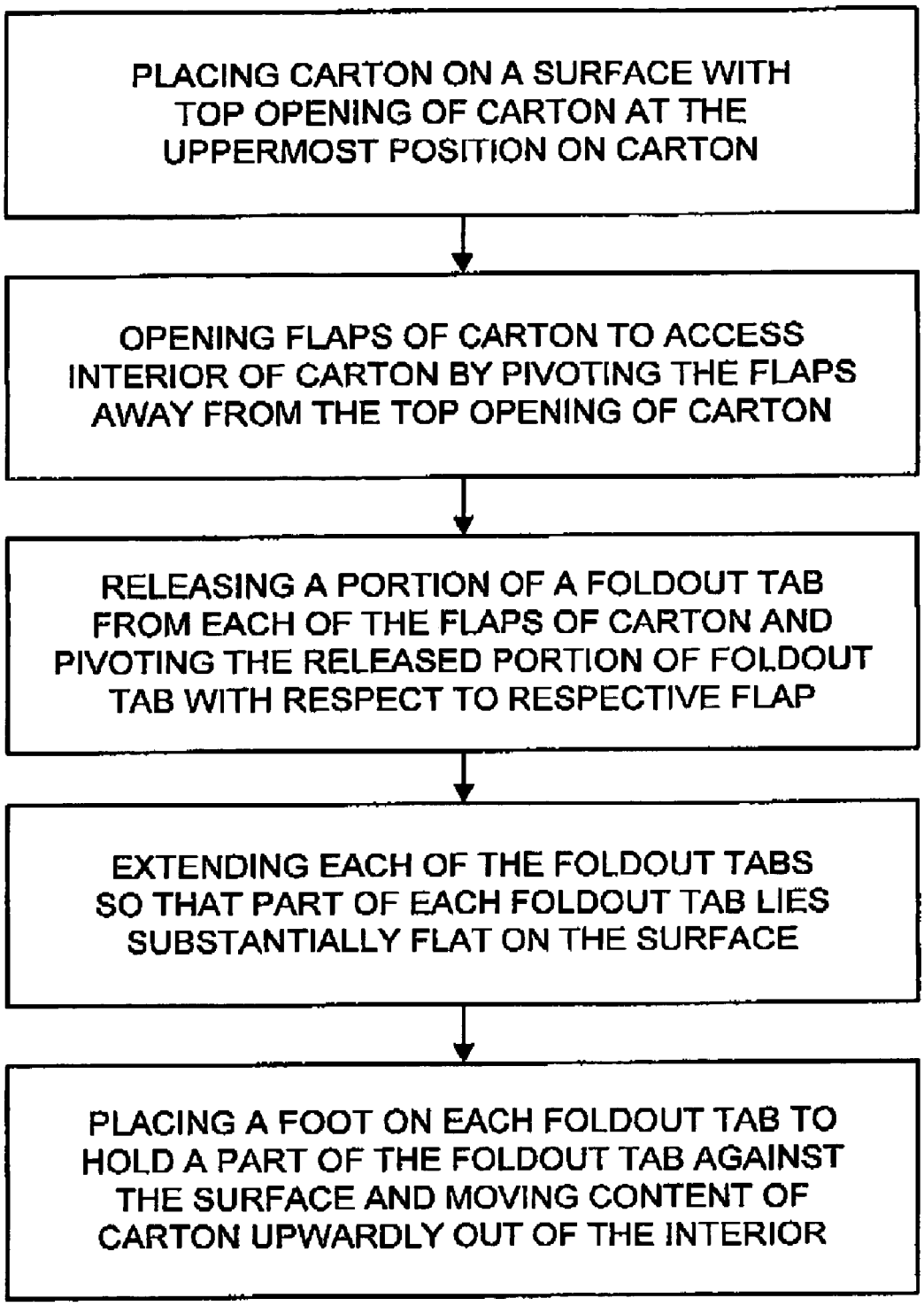
FIG. 5 shows the steps of utilizing the container.

FIG. 3 shows a shipping carton comprising a foldout tab in accordance with the present invention, with lid 120 substantially open and the foldout tab 140 extended and ready for use. The shipping carton 110 has two carton lid sections, 120 and 125. Lid section 120 is shown in substantially open position, while lid section 125 is shown still in its closed position. Foldout tab 140 and foot 130 have been separated from carton lid 120 and remain joined to carton lid 120 at hinge point 150. Foot 130 is set to rest on the same horizontal surface as the shipping carton 110 rests upon. It is connected to foldout tab 140 by binge line 160. In this position, a user (not shown) can place their foot on foot 130 to hold shipping carton 110 substantially on the surface that it is resting upon while lilting contents out. This will prevent shipping carton 110 from tending to lift up off the surface while the contents are being lifted. Although not shown, a similar foldout tab and foot can be integrated into the opposite lid 125 so that the user can place one foot on each side. Alternately, the foldout tab and foot can be integrated into one or both inside flaps instead of the outside lids so that their perforations are not exposed to external forces during shipping and so that after use, holes or voids will be on the inside flaps instead of the outside lids. Any number of foldout tabs may be integrated into various surfaces of the lids or inside flaps as needed. For boxes that have content that one person maybe capable of removing, perhaps two foldout tabs would suffice. For boxes with content that require two people to lift, perhaps four foldout tabs would be better. It is conceivable that for some boxes and content, that eight foldout tabs may be desirable, two on each lid and two on each inside flap.

Although the invention has been described with a certain degree of particularity, it should be recognized that elements thereof may be altered by persons skilled in the art without departing from the spirit and scope of the invention. It is believed that the foldout tab of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof, and further without providing substantial change thereto. It is the intention of the claims to encompass and include such changes.

What is claimed is:

1. An apparatus for assisting in the removal of contents from a carton comprising:

a carton; and at least one carton cover hingedly connected to said carton, said at least one carton cover has an outer edge and an inner fold line about which said at least one carton cover is pivotable with respect to said carton; and a foldout tab formed entirely by a portion of said carton cover and being releasable from a remainder portion of said carton cover, said at least one foldout tab being located between said outer edge and said inner fold line of said at least one carton cover:

wherein said foldout tab is pivotable about a hinge line with respect to said at least one carton cover, said hinge line being located toward said outer edge of said at least one carton cover and said foldout tab being located between said hinge line and said inner fold line of said at least one carton cover;

wherein said foldout tab further comprises a foot section that is hingedly connected to the body of said foldout tab and bends to lay substantially flat on a surface that said carton also lay upon and provides a place for the user to place a foot to hold said carton in place while removing said contents.

2. An apparatus according to claim 1, wherein the portion of said at least one carton cover forming said foldout tab is completely surrounded by the remainder portion of said at least one carton cover.

3. A method for removing contents from a carton, said carton having a pair of flaps pivotally mounted on opposite sides of said carton adjacent to a top opening of said carton, said method comprising:

placing said carton on a surface so that the lop opening of said carton is substantially at the uppermost position on said carton; and opening the flaps of said carton to access an interior of said carton by pivoting the flaps away from the top opening of said carton;

releasing a portion of a foldout tab from each of the flaps of said carton and pivoting the released portion of the foldout tab with respect to a respective one of said flaps;

extending each of said foldout labs so that part of each of said foldout tabs lies substantially flat on the surface; and placing a foot on each of said foldout labs to hold the part of said foldout tabs against the surface and thereby resist upward movement of the carton while said content is moved upwardly out of the interior of said carton.

4. A method according to claim 3, wherein said method further comprises:

bending a fool section of each of said foldout tabs with respect to a body section of the respective said foldout tab, said foot section being hingedly connected to said body section of each of said foldout tabs, allowing said fool section to lay substantially flat against the surface when extended towards the surface.

5. A method of claim 3, wherein the pivoting of each of said flaps away from the top opening of said carton is characterized by movement of a respective said flap in a first direction for the respective said flap; and wherein the pivoting of the released portion of said foldout tab with respect to the respective said flap is characterized by movement in a second direction that is opposite to said first direction of the pivoting movement of said flap from which said foldout tab is pivoted.

6. A shipping carton comprising:

a plurality of side components and bottom components angularly attached to each other to form a base enclosure; and a plurality of carton cover components that are hingedly connected to said plurality of side components that fold shut to close the top, closing the contents within, and fold open to expose the contents for removal, each of said carton cover components having an outer edge and an inner fold line about which the respective said carton cover component is pivotable with respect to said base enclosure; and a pair of foldout tabs, each foldout tab being disposed on opposite carton cover components of said plurality of carton cover components, each of said foldout tabs being formed by a portion of a respective one of said opposite carton cover components wherein each of said foldout tabs is pivotable along a hinge line located on the respective one of said opposite carton cover components so that said foldout tab is pivotable with respect to a remainder portion of the respective one of said opposite carton cover components;

wherein said hinge line of each of said foldout tabs is located toward said outer edge of the respective said carton cover component and said foldout tab is located between said hinge line and said inner fold line of the respective said carton cover component;

wherein each of said foldout tabs further includes a body section and a foot section that is hingedly connected to the body section of said foldout tab for providing a place for a user to place the user's foot.

7. An apparatus for assisting in the removal of contents from a carton as the carton rests on a surface, said apparatus comprising:

a carton having a top opening and a pair of flaps hingedly mounted on opposite sides of said carton, each of said flaps being pivotable between a closed condition in which said flap extends into said opening end an open position in which said flap is positioned substantially adjacent to one of the opposite sides of said carton; and a foldout tab being pivotally mounted on each of said opposite flaps;

wherein each of said flaps has an outer edge and an inner fold line about which said flap is pivotable between said closed condition and said open condition, each of said foldout tabs being positioned between said outer edge and said inner fold line of a respective one of said flaps:

wherein each of said foldout tabs is pivotable about a hinge line, said hinge line associated with each of said foldout tabs being located toward said outer edge of said flap and said foldout tab being located between the hinge line of said foldout lab and the inner fold line of said flap;

wherein each of said foldout tabs has a length between the hinge line of said foldout tab and an outboard free edge of said foldout tab;

wherein the length of said foldout tab is greater than a distance between the hinge line of said foldout tab and the outer edge of said flap such that said foldout tab is capable of reaching the surface on which the carton rests such that a portion of each of said foldout labs is restable on the surface adjacent to the opposite sides of the carton to permit a person to step on said portions while removing the contents from said carton through said top opening.

8. The apparatus of claim 7 wherein a portion of each of said foldout tabs is releasably mounted on a respective said flap such that said portion of said foldout tab must be released from said flap lo permit said foldout lab to be pivoted with respect to said flap.

9. The apparatus of claim 8 wherein each of said foldout labs is releasably mounted on the respective said flap by a line of perforations extending between said foldout tab and said flap.

10. The apparatus of claim 7 wherein each of said foldout tab is formed from a portion of a respective said flap.

11. The apparatus of claim 7 wherein each of said foldout tab is formed entirely from a portion of a respective one of said flaps.

12. The apparatus of claim 7 wherein each of said foldout labs is pivotable about a hinge line, the hinge line of each of said foldout tabs and the inner fold line of the respective said flap being substantially parallel.

13. The apparatus of claim 7 wherein each of said foldout tabs is entirely located between the outer edge and the inner fold line of a respective said flap.

14. The apparatus of claim 7 wherein each of said foldout tabs is made from a same material as said carton.

15. The apparatus of claim 7 wherein each of the foldout tabs and a respective one of the flaps on which said foldout tab is mounted are pivotable in opposite directions with respect to each other.

* * * * *